United States Patent [19]

Bauer

[11] 3,971,890

[45] July 27, 1976

[54] METHOD AND APPARATUS FOR QUADRAPHONIC ENHANCEMENT OF STEREOPHONIC SIGNALS

[75] Inventor: Benjamin B. Bauer, Stamford, Conn.

[73] Assignee: CBS Inc., New York, N.Y.

[22] Filed: Feb. 10, 1975

[21] Appl. No.: 548,329

[52] U.S. Cl. ..... 179/1 GQ; 179/100.4 ST

[51] Int. Cl.[2] ..... H04R 5/00

[58] Field of Search ..... 179/1 GQ, 1 G, 100.1 TD, 179/100.4 ST, 15 BT, 1 GP

[56] References Cited

UNITED STATES PATENTS

| | | | |
|---|---|---|---|
| 3,684,835 | 8/1972 | Orban | 179/1 GQ |
| 3,745,254 | 7/1973 | Ohta et al. | 179/1 GQ |
| 3,757,047 | 9/1973 | Ito et al. | 179/1 GP |
| 3,761,631 | 9/1973 | Ito et al. | 179/1 GP |
| 3,835,255 | 9/1974 | Bauer | 179/1 GQ |
| 3,885,101 | 5/1975 | Ito et al. | 179/1 GQ |
| 3,892,918 | 7/1975 | Takahashi et al. | 179/1 GQ |

*Primary Examiner*—Douglas W. Olms
*Attorney, Agent, or Firm*—Spencer E. Olson

[57] ABSTRACT

Method and apparatus are described for translating or "encoding" the left and right signals from a stereophonic source such that when the signals are reproduced by a four-channel decoder the resulting sound field is highly simulative of that produced from a quadraphonically-encoded record.

8 Claims, 15 Drawing Figures

METHOD AND APPARATUS FOR QUADRAPHONIC ENHANCEMENT OF STEREOPHONIC SIGNALS

FIELD OF THE INVENTION

This invention relates to sound reproduction systems, and more particularly to methods and apparatus for modifying signals available from a conventional stereophonic record such that when they are decoded with a four-channel decoder and the resulting four output signals applied to respective loudspeakers the resulting reproduction is similar to that produced by a quadraphonic record.

BACKGROUND OF THE INVENTION

During the past several years a number of methods and apparatus have been developed for combining four or more signals intended for reproduction over a four-loudspeaker system with predetermined amplitude and phase relationships which permit the composite signals to be decoded to recover the four or more original signals with sufficient accuracy that a credible fascimile of the original four-channel program can be reproduced over the four loudspeakers. One such system in commercial use, known as the "SQ" system, includes an encoder utilizing all-pass phase-shift networks and combining networks for producing two composite signals respectively containing as predominant components signals intended for reproduction over loudspeakers positioned at the left front and right front of the listening area and each containing reduced amplitude proportions of both of two signals intended for reproduction over loudspeakers positioned at the left back and right back corners, respectively, of the listening area, the two signals common to both composite signals in one of the composite signals having a substantially constant differential phase-shift angle of 90° relative to the corresponding common signals in the other composite signal. This type of encoder is described in detail in applicant's co-pending application Ser. No. 384,334 filed July 31, 1973 for "Encoders for Quadraphonic Sound System", now Pat. No. 3,890,466. The composite signals produced by this encoding technique not only are amenable to eminently satisfactory decoding but may also be reproduced satisfactorily on conventional stereophonic or monophonic phonographs in the usual manner. The SQ decoder, described in applicant's Pat. No. 3,835,255, derives from the encoded composite signals four output signals respectively containing one of the original input signals as a predominant component.

Although many SQ-encoded records are now available for home reproduction and/or FM broadcasting, the currently available catalog is insufficient for the broadcaster attempting to provide continuous or frequent periodic quadraphonic sevice, and, moreover, it cannot be expected that old time favorite records now available in stereo will soon be reissued in the SQ format. It is desirable, therefore, to be able to modify signals obtainable from conventional stereo records so that when applied to a four-channel decoder and reproduced on four loudspeakers a sound similar to that obtained from a quadraphonic record will result. The realism should be superior to that obtained when conventional stereophonic signals are played through a four-channel encoder, in which case the signals are mainly reproduced over the front channels, with any commonly random or out-of-phase reverberant signals that might be contained in the stereophonic signals transferred in part to the back channels, to create a pleasing ambience which envelopes the listener. This effect, however, is not "quadraphonic enhancement" in the sense that this term is used in the present application.

Although a number of systems have heretofore been proposed for obtaining a four-channel effect from a stereophonic source, examples of which are described in Hafler Pat. No. 3,697,692, and Ito et al Pat. Nos. 3,761,631 and 3,757,047, they do not provide acceptable quadraphonic realism, and do not address the problem of providing quadraphonically-enhanced signals suitable for FM broadcasting and subsequent decoding into four signals for presentation on respective loudspeakers. A more recently proposed system, described in a paper entitled "QS Quadrophonic Synthesizer: What It Does and How It Does It" presented at the 49th Convention of the Audio Engineering Society held on September 9–12, 1974, and distributed as an AES Preprint, involves pre-encoding of the left and right stereo signals preparatory to decoding in a QS vario-matrix four-channel decoder. Encoding is achieved by reverse-phase blending between the left and right stereo signals, a consequence of which is that the total and relative energy content of the encoded signals is altered relative to the energy content of these signals in the stereophonically related signals, resulting in incorrect or low-fidelity sound reproduction.

It is an object of the present invention to provide a method and apparatus for pre-encoding stereophonically related signals derived from a conventional stereo record to produce "encoded" left and right signals which, when played through an SQ decoder and the four output signals therefrom reproduced by respective loudspeakers arranged to define a quadraphonic listening area, the resulting sound field is similar to that obtained from an SQ-encoded quadraphonic record.

BRIEF DESCRIPTION OF THE INVENTION

According to this invention, a method and apparatus are provided for pre-encoding left and right stereophonic signals, obtained, for example, from a conventional stereophonic record, to produce two encoded signals which when replayed through an SQ decoder produce four output signals which when reproduced on respective loudspeakers positioned at the four corners of a listening area produces a quadraphonic effect. Designating the left and right stereophonic signals as having L + C and R + C components, respectively, the method comprises the steps of transferring at least a first predetermined reduced amplitude proportion of the L + C component to a first output channel and said first predetermined reduced amplitude portion of the R + C component to a second output channel, without relative phase shift betweem them, transferring a second predetermined reduced amplitude proportion of the L + C component to the second output channel with a lagging quadrature phase relative to the R + C component in the second channel, and transferring said second predetermined reduced amplitude proportion of the R + C component to the first output channel with a lagging quadrature phase relative to the L + C component in the first channel. According to one embodiment, the first reduced amplitude proportion is 0.71 of the L + C and R + C components, respectively, and are transferred to the first and second output channels, respectively, along with full amplitude L + C and R + C components, also without relative phase shift between them, and the second predetermined amplitude proportion has a value of 0.71, whereby the encoded signal in the first output channel has a first component proportional to 1.71 (L + C) and a second component 0.71 (R + C) in quadrature therewith and the encoded signal in the second output channel has a first component proportional to 1.71 (R + C) and a second component 0.71 (L + C) in quadrature therewith. To balance the total and relative energy content of the encoded signals with the total and relative energy content of the original stereophonic signals, all of the components of the encoded signals are attenuated by the same factor such that the amplitudes of the predominant and subdominant components of each of the output signals are in the ratio of 0.92:0.38. Encoding according to this embodiment produces a degree of quadraphonic enhancement, when the encoded signals are decoded with a SQ decoder, simulative of the mapping of a stereophonic record to a semi-circle surrounding the listener and is characterized as "180° enhancement".

According to another embodiment, the first and second predetermined reduced amplitude proportions are equal and have a value of 0.71, and the full amplitude (L + C) and (R + C) components are not transferred to their respective output channels. Thus, the encoded signal in the first output channel contains 0.71 (L + C) and 0.71 (R + C) in lagging quadrature relationship, and the other encoded signal contains 0.71 (R + C) and 0.71 (L + C) in lagging quadarture relationship. This type of encoding causes the reproduced stereophonic image to be bent into a "horseshoe" by "stretching" the left stereophonic signal into the left back loudspeaker and the right stereophonic signal into the right back loudspeaker, while retaining reproduction of the stereophonic center signal, C, in between the two front loudspeakers, as with conventional stereo. This is characterized as "270° enhacement" because it covers three quadrants of an imaginary circle surrounding the listener.

Pre-encoding of the stereo signals according to either embodiment is conveniently accomplished by slight modification of either a commercially available SQ encoder of the type described in the aforementioned Pat. No. 3,890,466, or a commercially available SQ decoder of the type described in U.S. Pat. No. 3,835,255.

DESCRIPTION OF THE DRAWINGS

The invention will be more fully understood from the following description when taken in conjunction with the accompanying drawings in which.

DESCRIPTION OF THE PREFERRED EMBODIMENTS

Figure 1:
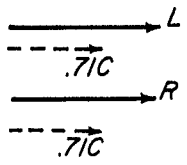
FIG. 1 is a phasor representation of typical stereophonic signals.

The stereophonic signals to be quadraphonically enhanced, be they derived from a stereophonic disc record, a magnetic tape record or any other record medium carrying stereophonic signals, are shown in phasor notation in FIG. 1. For convenience in the description to follow, these signals will be described as having been obtained from a typical stereophonic disc record which, as is well known, has two independent channels which may be characterized as $L_T$ and $R_T$, the former carrying a left signal L accompanied by a fractional portion, usually 0.71, of the "center" signal, and the $R_T$ channel carrying the "right" signal R also accompanied by 0.71 of the center signal C. As illustrated, the 0.71C component is in phase with the main signal in both channels.

It is also known that because the individual signals are mathematically incoherent any cross-products thereof integrated over a period of time are equal to zero, the total energy contained in the record is proportional to the sum of the squares of all of the individual signals contained in both channels. Thus, the total energy in the stereophonic record may be expressed by the following equation:

$$\text{Power} = L^2 + 0.5C^2 + R^2 + 0.5C^2$$

$$= L^2 + C^2 + R^2 \qquad (1)$$

Figure 2:
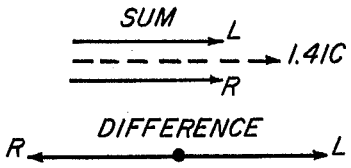
FIG. 2 is a phasor representation of the sum and of the difference of the signals depicted in FIG. 1.

As further background for understanding the advantages of the present invention, it is conventional in the transmission of stereophonic signals over FM-multiplex radio to employ the sum of $L_T$ and $R_T$ as frequency modulation of the carrier and the difference of the two signals ($L_T - R_T$) is amplitude modulated about a 38KHz subcarrier (which is suppressed during transmission) also frequency modulated as part of the transmission process. It is important for an application of the merits of the present quadraphonic enhancement method and its advantages over known methods to keep in mind the power relationships between these two sets of signals involved in FM-multiplex transmission. Referring to FIG. 2, the sum of $L_T$ and $R_T$ is seen to consist of the L signal, the R signal and a 1.41C signal. The total power contained in the sum signal is proportional to $$\text{Power} = L^2 + R^2 + 2C^2 \quad (2)$$

The difference signal, however, contains no C component, and its power is proportional to $$\text{Power} = L^2 + R^2 \quad (3)$$

The relative power of the individual signals L, R and C being approximately equal in most stereo disc records, a comparison of equation (3) with equation (2) reveals that the power in the subcarrier modulation is one-half of that in the audio baseband modulation. One application of the present invention being the FM-multiplex broadcasting of quadraphonically enhanced stereo signals derived from a stereo disc record, an important factor in the effectiveness of any quadraphonic enhancement technique is the maintenance of this power relationship in the sum and difference of the encoded signals.

The quadraphonic enhancement according to the invention can be carried out in a number of ways, two to be described involving utilization of known, commercially available components of the SQ four-channel system. Particularly suitable is the so-called "forward-oriented" encoder illustrated in FIG. 20 of applicant's co-pending application Ser. No. 384,334 filed July 31, 1973, now U.S. Pat. No. 3,890,466, and also described in an article entitled "Recording Techniques for SQ Matrix Quadraphonic Discs" appearing in the January/February 1973 issue of the Journal of the Audio Engineering Society. This type of encoder is for convenience shown within the dotted line enclosure 10 in FIG. 3 and consists of four summing junctions 12, 14, 16 and 18 interconnected with four all-pass phase shift networks 20, 22, 24 and 26 in such a way that when in-phase $L_f$, $L_b$, $R_b$ and $R_f$ signals are applied to respective input terminals 28, 30, 32 and 34, two composite output signals $L_T$ and $R_T$ represented by the phasor groups 36 and 38, respectively, are produced at output terminals 40 and 42. It will be observed that the $L_f$ and $R_f$ signals are predominant in $L_T$ and $R_T$, respectively, and are in the same relative phase as at the input terminals, that reduced amplitude proportions of both of the "back" signals appear in both composite signals in quadrature relationship, with $L_b$ in phase with $L_f$ in the $L_T$ composite signal and with $R_b$ in phase with the $R_f$ component in the $R_T$ signal.

Figure 3:
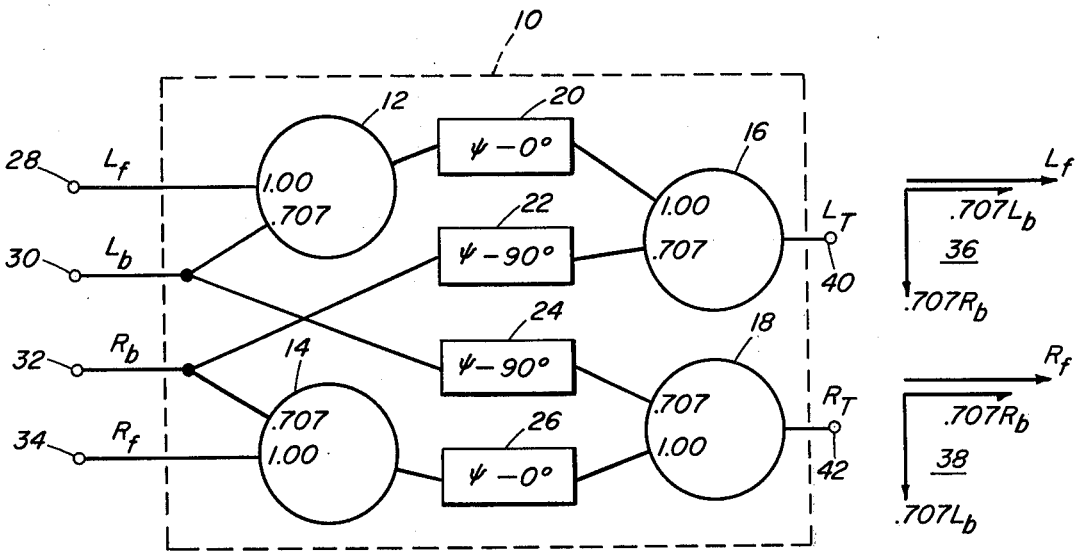
FIG. 3 is a schematic diagram of an SQ encoder useful in the practice of the method according to the invention.
Figure 4:
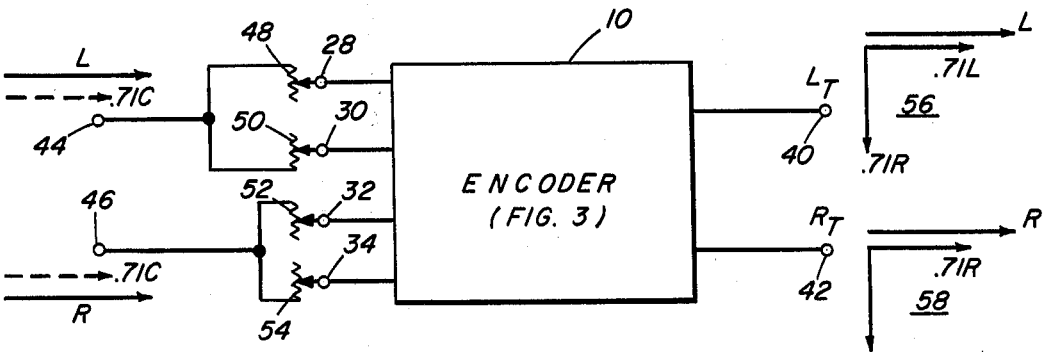
FIG. 4 is a schematic diagram illustrating a first embodiment of the present invention utilizing the encoder of FIG. 3.

FIG. 4 illustrates how the encoder 10 of FIG. 3 is modified to accomplish quadraphonic enhancement of stereophonic signals. As shown, input terminals 28 and 30 of the encoder are connected together and to a single input terminal 44 to which the left signal from a stereophonic source is applied, and terminals 32 and 34 are similarly connected together and to an input terminal 46 to which the right signal is applied. Additionally, each of the four input lines to the encoder has an attenuator inserted therein, schematically indicated at 48, 50, 52 and 54, for individually adjusting the level of the signals applied to the encoder, the reason for which will be evident as the description proceeds.

Assuming for the moment that the attenuators are all set for zero attenuation, and that the 0.71C components are not present, it will be evident from FIG. 3 that the full L signal is transferred via junction 12, phase shifter 20 and junction 16 to output terminal 40 without relative phase shift, that a reduced amplitude portion (0.707) of the L signal is transferred via junction 12, phase shifter 20 and summing junction 16 to output terminal 40, and that 0.707 of the R signal, phase shifted by 90° by phase shifter 22 and reduced in amplitude by the factor 0.707 in summing junction 16 is transferred to output terminal 40, to produce the composite signal depicted by phasor group 56. Similarly, the full R signal is transferred through junction 14, phase shifter 26 and junction 18 to output terminal 42, a reduced amplitude portion of R is transferred from terminal 32 via junction 14, phase shifter 26 and junction 18 to output terminal 42, and a reduced amplitude, relatively phase shifted portion of the L signal is transferred from terminal 30 via phase shifter 24 and junction 18 to terminal 42, producing the composite signal depicted by phasor group 58. There being in-phase L components in $L_T$ and in-phase R components in $R_T$, they are linearly additive so that the encoded signals shown in FIG. 4 can be depicted as illustrated in FIG. 5; that is, the $L_T$ signal, identified as phasor group 60, consists of a 1.71L component and a 0.71R component in quadrature therewith, and the $R_T$ signal, shown in phasor group 62, consists of 1.71R and 0.71L in quadrature therewith.

Turning now to the case where a center signal C is contained as a fraction 0.71C in each original signal channel of the stereo disc, it will be appreciated from the foregoing analysis that portions of the 0.71C signal are coupled to each of output terminals 40 and 42 which upon being vectorially added, produces a C signal contribution to each composite signal of an amplitude 1.30C at a phase angle relative to the other two phasor components.

Figure 5:
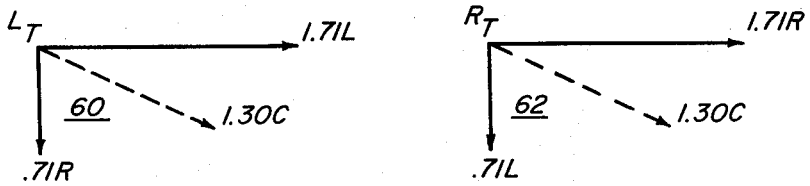
FIG. 5 is a phasor representation of the encoded or enhanced stereophonic signals produced by the system of FIG. 4.

While the power of the encoded signal shown in FIG. 5 is balanced, it is desirable for reasons which will become apparent to normalize the composite signals $L_T$ and $R_T$ to have a total power equal to that inherent in the signals recorded on the stereo disc. Calculation has shown that this equality will exist if the encoded signals have the properties illustrated in the phasor groups of FIG. 6; this is accomplished by multiplying each of the individual phasors in FIG. 5 by the fraction $0.924/1.707 = 0.541$. In practice, this is conveniently accomplished by setting the attenuators 48, 50, 52 and 54 to an attenuation figure of $20 \log 0.541 = -5.3$db.

Figure 6:
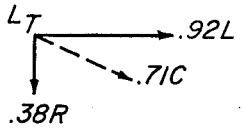
FIG. 6 is a phasor representation of the signals depicted in FIG. 5 except that each of its components is reduced by a predetermined factor.
Figure 7:
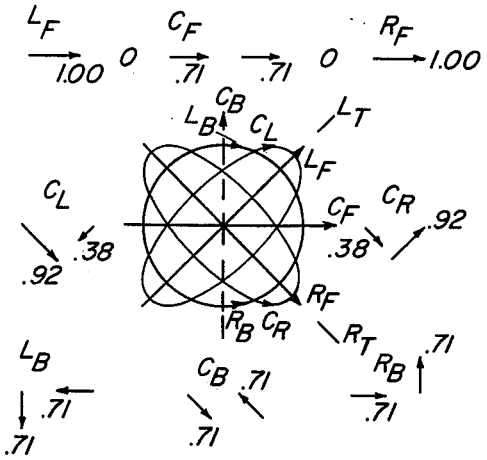
FIG. 7 is a diagram illustrating the position code for an SQ matrix.
Figure 10:
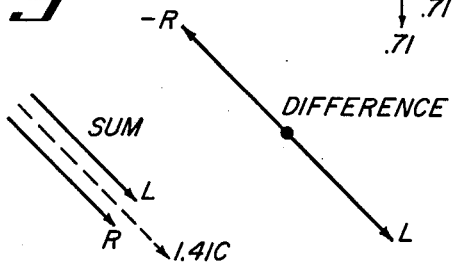
FIG. 10 is a phasor representation of the sum and of the difference of the signals depicted in FIG. 9.
Figure 13:
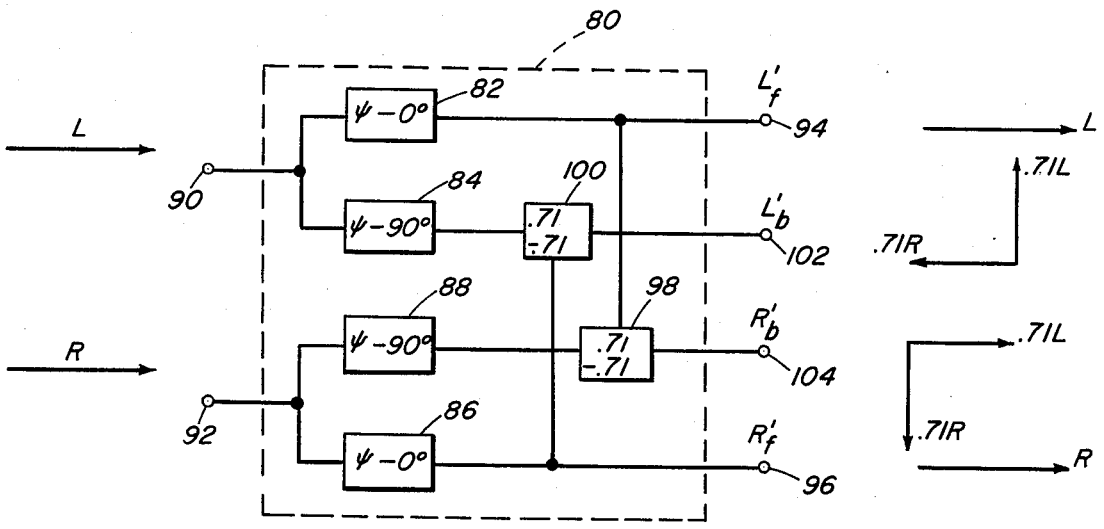
FIG. 13 is a schematic diagram of an SQ decoder, also useful in the practice of the invention.

That the encoded signals shown in FIG. 6 will upon being decoded by an SQ decoder and its four output signals applied to appropriately located loudspeakers achieve quadraphonic enhancement will be evident from FIG. 7 which depicts in phasor notation optimum SQ modulations for the side, as well as the front and back, quadrants of a quadraphonic listening area. FIG. 7 corresponds to FIG. 7 of an article entitled "Quadraphonic Matrix Perspective--Advances in SQ Encoding and Decoding Technology" appearing in the June 1973 issue of the Journal of the Audio Engineering Society. As pointed out therein, a position encoder produces signal pairs $L_T$ and $R_T$ designed so as to provide optimum SQ modulations, and in FIG. 7, the eight pairs of arrows surrounding the vector diagram represent the $L_T$ and $R_T$ phasors corresponding to "panning" a unity strength signal to the assigned directions. Of particular significance to the present invention, it is to be noted that the $C_L$ and $C_R$ phasors each have quadrature related components of relative amplitudes of 0.92 and 0.38 which result in two elliptical motions co-axially with $L_T$ and $R_T$, respectively, the projections of which on the horizontal line are of the same length as those for $L_f$, $R_f$, $L_b$ and $R_b$. It will be noted from FIG. 6 that the L signal has the fractional value 0.92L in $L_T$ and 0.38L in $R_T$, the latter being in quadrature lagging relationship with respect to the former. Similarly, the R signal is present in the $R_T$ signal as 0.92R and in the $L_T$ signal as 0.38R, the latter lagging the former by 90°. Thus, the phasor composition of $L_T$ and $R_T$ correspond precisely to the $C_L$ and $C_R$ signals, respectively, in FIG. 7. The center signal appears in both $L_T$ and $R_T$ in equal amount, namely, 0.71C, and they are in phase. This relationship corresponds to the condition depicted in FIG. 7 for a center front ($C_f$) signal; i.e., two in-phase vectors each of 0.71 amplitude. It follows, therefore, that when the signals of FIG. 6 are decoded with an SQ decoder of the type described in the aforementioned Pat. No. 3,835,255 (one form of which is illustrated in FIG. 13 of this application), the respective L, C and R signals will be decoded as $C_L$ (center left), $C_f$ (center front) and $C_R$ (center right), respectively, so as to "bend" the sound field surrounding the listener into an 180° arc of "horseshoe" shape.

Figure 8:
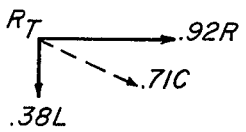
FIG. 8 is a phasor representation of the sum and of the difference of the signals depicted in FIG. 6.
Figure 8:
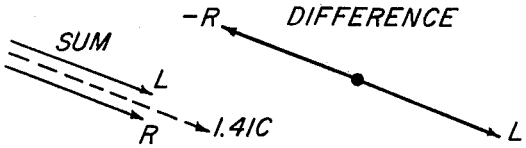

That the encoded signals of FIG. 6 are amenable to conventional FM-multiplex radio broadcast is illustrated in FIG. 8 which depicts the sum and the difference of the two signals. Comparison of these with the sum and difference signals illustrated in FIG. 2 shows them to be identical; it therefore follows from the discussion in connection with FIG. 2 that the encoded signals of FIG. 6 can be broadcast via FM-multiplex in a normal manner.

Degrees of enhancement different from that described above can be obtained with the apparatus of FIG. 4 by using different adjustments of the attenuators 48, 50, 52 and 54. For example, if attenuators 48 and 54 are adjusted to provide infinite attenuation (open-circuited) and attenuators 50 and 52 are adjusted for no attenuation, it will be seen from FIG. 3 that the full L and R signals will not be transferred to the output terminals, but that only reduced amplitude portions, namely, 0.707, of both L and R are transferred to both output terminals to produce the encoded $L_T$ and $R_T$ signals shown in FIG. 9. Comparison of the phasor 0.71L in $L_T$ and the phasor 0.71L in $R_T$ with the corresponding phasors at the $L_B$ position in FIG. 7 shows them to be in correspondence; consequently, upon decoding with an SQ decoder, the signal will appear as a "left back" decoded signal. Likewise, the phasor 0.71R in $R_T$ and the phasor 0.71R in $L_T$ correspond to the phasor pair designated $R_B$ in FIG. 7; therefore, it will be decoded as a "right back" decoded signal. The center signal, however, represented by the dotted line vectors of value 0.71C, are equal and in phase in $L_T$ and $R_T$, and therefore appear at "center front" upon decoding. Thus, this adjustment of the attenuators causes the mapping or bending of the stereo signal through an angle of 270°, producing a very dramatic effect, especially with popular music.

Figure 11:
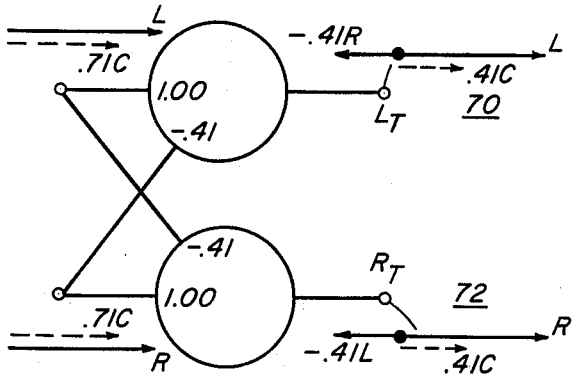
PRIOR ART FIG. 11
FIG. 11 is a schematic diagram of a prior art encoder for quadraphonic enhancement, illustrating in phasor notation the signals encoded thereby.
Figure 12:
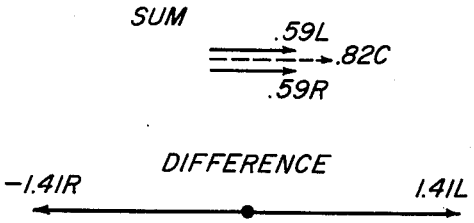
FIG. 12 is a phasor representation of the sum and of the difference of the signals depicted in FIG. 11.

That the above-described methods for achieving quadraphonic enhancement of a stereo signal produce results superior to those achieved by the encoding technique described in the aforementioned AES Preprint will be evident from the following analysis with reference to FIGS. 11 and 12. In this prior art method, the stereophonic signals respectively containing L and R and each containing 0.71C are combined by subtracting a fraction 0.41 of each from the other to produce the encoded $L_T$ and $R_T$ signals depicted by phasor groups 70 and 72, respectively. It is seen that in both encoded signals the center signal C is reduced to the fraction 0.41C from its former value of 0.71C, this corresponding to a reduction in power of 20 log 0.41/0.71 = 4.65db, while at the same time the power of the L and R signals has increased to $L^2 + R^2 + 0.41^2L^2 + 0.41^2R^2 = 1.17L^2 + 1.17R^2$, an increase of 0.7 db, resulting in a total imbalance of signal power of 5.4db. The effect of this type of encoding on FM-stereo broadcasting will be seen from examination of FIG. 12 which shows the sum and the difference of the signals corresponding to phasor groups 70 and 72. In this case the power in the sum signal is, $$\text{Power} = 0.59^2L^2 + 0.82^2C^2 + 0.59^2R^2$$

$$= 0.35L^2 + 0.67C^2 + 0.35R^2$$

and the power in the difference signal is, $$\text{Power} = 2L^2 + 2R^2$$

It is evident from these relationships that if the signals L, C and R initially have the same power, which is usually the case, the sum signal has a relative total power of 0.35 + 0.67 + 0.35 = 1.37 wherein the difference signal has a relative total power of 2 + 2 = 4; thus the ratio of the difference and sum powers is 4/1.37 = 2.92 as compared with the ratio of 0.5 for the original stereophonic signal, as outlined above. Therefore, this prior method of quadraphonic enhancement does not provide as efficient transmission through FM-stereo transmitters as does the encoding method of the present invention.

Figure 9:
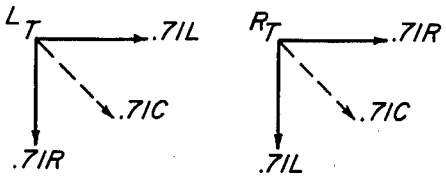
FIG. 9 is a phasor representation of signals produced by the system of FIG. 4 for a different condition of attenuation of selected signals than for the signals depicted in FIGS. 5 and 6.

The enhancement method according to the present invention can be carried out by any combination of phase-shifters and combining junctions which will produce the desired phasor relationships depicted in FIGS. 5, 6 and 9, another example being a suitably modified SQ decoder of the kind described in Pat. No. 3,835,225, which for convenience is illustrated in FIG. 13. Briefly, the decoder 80 includes two pairs of phase-shift networks 82 and 84 and 86 and 88, one network of each pair being operative to shift the phase of an applied signal by a reference angle, $\psi$, and the other network of each pair being operative to introduce a phase-shift angle differing from the reference angle by 90°. A first input terminal 90 is connected to the input of both networks of the first pair and a second input terminal 92 is connected to the input of both networks of the second pair. The outputs of networks 82 and 86 are connected to first and second output terminals 94 and 96, respectively, labeled $L_f'$ and $R_f'$, and are also combined in summing junctions 98 and 100, with attenuation proportional to 0.71, with correspondingly attenuated output signals from other network of the opposite pair to produce output signals at two other output terminals 102 and 104, labeled $L_b'$ and $R_b'$, respectively. In the usual application of the decoder, the $L_f'$ and $R_f'$ signals are applied to loudspeakers positioned at the left and right front corners, and the $L_b'$ and $R_b'$ are applied to loudspeakers positioned at the left and right back corners of the quadraphonic listening area.

Figure 14:
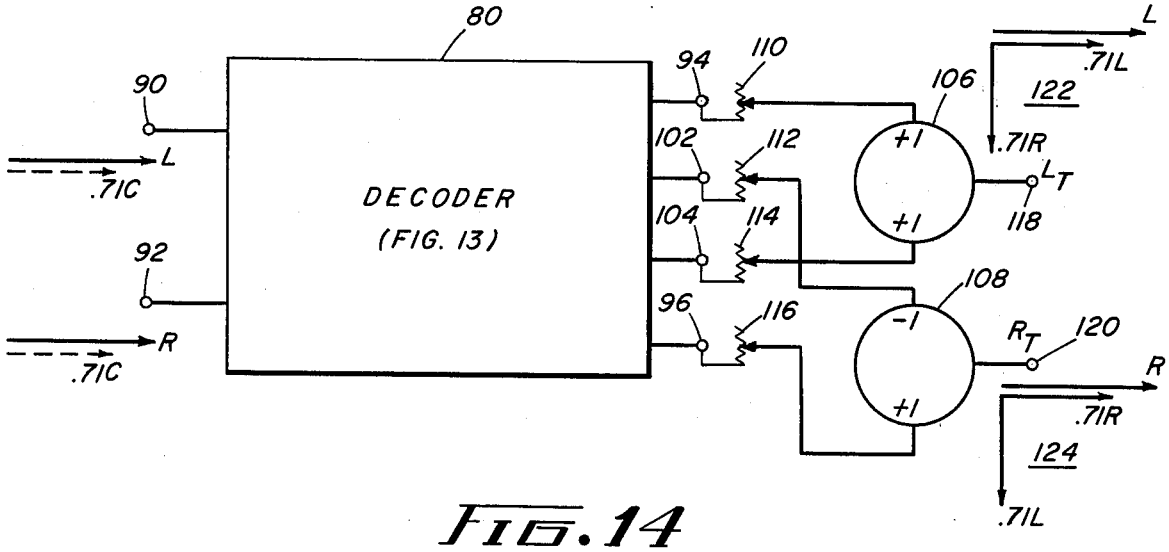
FIG. 14 is a schematic diagram of another embodiment of the invention utilizing the decoder of FIG. 13.
Figure 15:
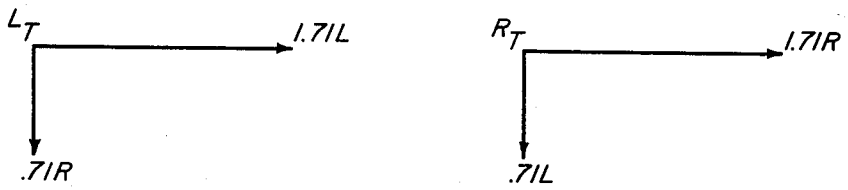
FIG. 15 is a phasor representation of the encoded signals produced by the circuit of FIG. 14.

It is seen that if the left (L) and right (R) signals from a stereophonic source are respectively applied to input terminals 90 and 92, the decoder is operative to produce at the output terminals 94, 96, 102 and 104 the signals depicted by the phasor groups adjacent the terminals. The enhancement function is accomplished by the modifications of the decoder 80 shown in FIG. 14, namely, providing a first summing junction 106 for adding the signals at output terminals 94 and 104, a second junction 108 for subtracting the signal at terminal 102 from the signal at terminal 96, and four attenuators 110, 112, 114 and 116, one in each of the output lines. With all of the attenuators adjusted for zero attenuation, and L and R signals applied to input terminals 90 and 92, respectively, the resulting signals appearing at the output terminals 118 and 120 of junctions 106 and 108 are as depicted by phasor groups 122 and 124, which, it will be noted, correspond to phasor groups 56 and 58 which depict the encoded signals produced by the system of FIG. 4. Obviously, when like components in the two signals are combined the signals may be represented as shown in FIG. 15, which, again, are identical to the phasor groups 60 and 62 in FIG. 5. Thus, if the power of the component signals is normalized as discussed above in connection with FIG. 5, 180° enhancement will result. Similarly, if attenuators 110 and 116 are adjusted for infinite attenuation, and attenuators 112 and 114 are adjusted for zero attenuation, the resulting encoded signals will have the composition shown in FIG. 9 so as to provide 270° enhancement. Therefore, the decoder connected as shown in FIG. 14 correctly performs the enhancing function, which, moreover, can by proper adjustment of the attenuators, be made to produce the desired degree of enhancement.

I claim:

1. The method of processing first and second stereophonically related signals respectively containing left (L) and center (C) components and right (R) and center (C) components wherein the C signal components to the extent they are present are common and in phase with their respective L and R components, to produce two signals which when reproduced by a four-channel decoder and loudspeaker system produce a sound field simulative of that produced from a quadraphonically-encoded record, said method comprising the steps of:

transferring at least a first predetermined reduced amplitude proportion of said first and second signals to first and second output channels, respectively, without relative phase shift between them, transferring said first predetermined reduced amplitude proportion of said first signal to said second output channel with a phase shift of about 90° lagging relative to the first signal in said first output channel, and transferring said first predetermined reduced amplitude proportion of said second signal to said first output channel with a phase shift of about 90° lagging relative to the first signal in said first output channel.

2. The method of claim 1 including the additional steps of:

transferring a second predetermined proportion of said first signal to said first output channel without relative phase shift, and transferring said second predetermined proportion of said second signal to said second output channel without relative phase shift.

3. The method of claim 1 wherein said first predetermined reduced amplitude proportion has a fractional value of about 0.71.

4. The method of claim 2 wherein the said first predetermined reduced amplitude proportion and said second predetermined proportion have different fractional values and said different fractional values are so related to each other as to provide in said first output channel a composite signal containing an L component having an amplitude of about 0.92L and an R component in lagging quadrature phase relationship therewith having an amplitude of about 0.38R, and to provide in said second output channel a composite signal containing an R component having an amplitude of about 0.92R and an L component in lagging quadrature phase relationship therewith having an amplitude of about 0.38L.

5. Apparatus for processing first and second stereophonically related signals respectively containing left (L) and center (C) components and right (R) and center (C) components wherein the C signal components to the extent they are present are common and in phase with their associated L and R components to produce two signals which when reproduced by a four-channel decoder and loudspeaker system produce a sound field simulative of that produced from a quadraphonically encoded record, said apparatus comprising:

first and second input terminals for receiving said first and said second signals, respectively, first and second output terminals, means including first attenuator means connected between said first input terminal and said first output terminal for transferring at least a first predetermined reduced amplitude proportion of said first signal to said first output terminal without relative phase shift, means including second attenuator means connected between said second input terminal and said second output terminal for transferring at least said first predetermined reduced amplitude proportion of said second signal to said second output terminal without relative phase shift, means including said second attenuator means and first phase-shifting means connected between said second input terminal and said first output terminal for transferring said first predetermined reduced amplitude proportion of said second signal to said first output terminal with a phase shift of about 90° lagging relative to the first signal at said first output terminal, and means including said first attenuator means and second phase-shifting means connected between said first input terminal and said second output terminal for transferring said first predetermined amplitude proportion of said first signal to said second output terminal with a phase shift of about 90° lagging relative to the second signal at said second output terminal.

6. Apparatus according to claim 5, wherein said first predetermined reduced amplitude proportion has a fractional value of about 0.71.

7. Apparatus according to claim 5, further including means including third attenuator means connected between said first input terminal and said first output terminal for transferring a second predetermined proportion of said first signal to said first output terminal without relative phase shift, and means including fourth attenuator means connected between said second input terminal and said second output terminal for transferring said second predetermined proportion of said second signal to said second output terminal.

8. Apparatus according to claim 7 wherein said first and second attenuator means are operative to provide equal attenuation in a first amount and said third and fourth attenuator means are operative to provide equal attenuation in a second amount, said first and second amounts of attenuation being so related to each other as to provide at said first output terminal a composite signal containing an L component having an amplitude of about 0.92L and an R component in lagging quadrature relationship therewith having an amplitude of about 0.38R, and to provide at said second output terminal a composite signal containing an R component having an amplitude of about 0.92R and an L component in lagging quadrature relationship therewith having an amplitude of about 0.38L.

* * * * *